US012140004B2

(12) United States Patent
Brown et al.

(10) Patent No.: US 12,140,004 B2
(45) Date of Patent: Nov. 12, 2024

(54) SIDE POCKET MANDREL PROMOTING HIGH INTERNAL VELOCITY

(71) Applicant: Baker Hughes Oilfield Operations LLC, Houston, TX (US)

(72) Inventors: Donavan Brown, Houston, TX (US); Ronnie Russell, Houston, TX (US); Griffin Koehler, Houston, TX (US); Laura Walker, Houston, TX (US); Stephen Satterlee, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/971,186

(22) Filed: Oct. 21, 2022

(65) Prior Publication Data

US 2024/0133276 A1 Apr. 25, 2024
US 2024/0229621 A9 Jul. 11, 2024

(51) Int. Cl.
*E21B 43/12* (2006.01)
*E21B 23/03* (2006.01)
*E21B 23/12* (2006.01)

(52) U.S. Cl.
CPC ..... *E21B 43/123* (2013.01); *E21B 23/03* (2013.01); *E21B 23/12* (2020.05)

(58) Field of Classification Search
CPC ..... E21B 43/123; E21B 23/03; E21B 23/12
See application file for complete search history.

(56) References Cited

U.S. PATENT DOCUMENTS 4,106,564 A 8/1978 Tausch
4,201,265 A 5/1980 Logan et al.
4,480,687 A 11/1984 Terral
7,063,152 B2 6/2006 Yeo et al.
7,069,992 B2 7/2006 Lewis et al.
7,228,897 B2 6/2007 Holt et al.
7,373,890 B2 5/2008 Kowalchuk
7,464,758 B2 12/2008 Yeo et al.
2004/0112599 A1 6/2004 Holt et al.
2005/0072575 A1* 4/2005 Yeo ..... E21B 34/063 166/317
2015/0159466 A1 6/2015 Themig et al.

OTHER PUBLICATIONS

International Search Report and Written Opinion for PCT/US2023/076970 mailed Feb. 14, 2024.

* cited by examiner

*Primary Examiner* — Kelsey E Cary
(74) *Attorney, Agent, or Firm* — Baker Hughes Patent Organization

(57) ABSTRACT

A side pocket mandrel for use in a gas lift system is configured to improve the recovery of petroleum fluids from a well. The side pocket mandrel includes an upper assembly joint, a lower assembly joint, and a central portion that has a total length ($L_T$). The side pocket mandrel further comprises a central bore extending through the side pocket mandrel along a central longitudinal axis that extends through the upper and lower assembly joints. The side pocket mandrel further includes a tool channel offset from the central bore and a side pocket tube linearly aligned with the tool channel and configured to receive a gas lift valve. The side pocket mandrel further includes a pair of primary flow blocks that each have a length ($L_{Fa}$) that is at least 35% of the total length ($L_T$) of the central portion of the side pocket mandrel.

18 Claims, 5 Drawing Sheets

SIDE POCKET MANDREL PROMOTING HIGH INTERNAL VELOCITY

FIELD OF THE INVENTION

This invention relates generally to the field of oil and gas production, and more particularly to a gas lift system that incorporates an improved side pocket mandrel that better tolerates use in cementing applications.

BACKGROUND

Gas lift is a technique in which gaseous fluids are injected into the tubing string to reduce the density of the produced fluids to allow the formation pressure to push the less dense mixture to the surface. In annulus-to-tubing systems, pressurized gases are injected from the surface into the annulus, where the pressurized gases enter the tubing string through a series of gas lift valves. Alternatively, in tubing-to-annulus systems, pressurized gases are injected into the tubing string and discharged into the annulus, where the gases help to produce fluids out of the annulus. A series of gas lift valves allow access from the annulus into the production tubing or from the production tubing into the annulus. The gas lift valves can be configured to automatically open when the pressure gradient between the annulus and the production tubing exceeds the closing force holding each gas lift valve in a closed position.

To permit the unimpeded production of wellbore fluids through the production tubing, the gas lift valves are housed within "side pocket mandrels" that include a valve pocket (or side pocket tube) that is laterally offset from the production tubing. Because the gas lift valves are contained in these laterally offset valve pockets, tools can be deployed and retrieved through the open primary passage (central bore) of the side pocket mandrel. The predetermined position of the gas lift valves within the production tubing string controls the entry points for gas into the production string.

When a well is first opened, the reservoir may have sufficient internal driving energy to produce a commercially adequate flow of the formation fluid to the surface. In time, however, that internal energy source may be dissipated long before the reservoir value is depleted. Production experience may anticipate such production developments by positioning side pocket mandrels in the production tube long before the actual need for gas lifted production. When the need for gas lifting arises, the only downhole operations required to begin gas lifting are the wireline placement of the gas lift valve elements in the respective side pockets. When compared to the enterprise of withdrawing and returning several miles of production tubing or coil tubing in a well, wireline procedures are minimal.

Such considerations are more imperative in those cases in which much of the well bore remains uncased. Extremely deep or long, horizontal well bores are examples. Below the casing, the raw borehole remains uncased through the formation production face. Completion of the well may include a single "trip" placement of production tube with cross-over and cementing valves. The well annulus between the production tube and borehole wall is cemented above the production zone for isolation. Production flow from the production zone is opened by perforating the production tube and surrounding cement annulus.

The pre-deployment of gas lift modules complicates the single-trip process of pumping cement slurries through the production tubing into the well because the cement slurry tends to settle inside voids within the side pocket mandrel.

Although traversal of the wiper plug through each mandrel displaces most of the cement that has entered the mandrel during the annulus cementing operation, residual cement nonetheless remains in the mandrel void spaces that are essential for inserting and removing side pocket valves, plugs and instruments. Should this residual cement be allowed to set within a mandrel, it may be impossible to make full use of the side pocket mandrel.

To mitigate the risks of compromising the functionality of side pocket mandrels, specialized side pocket mandrels have been developed for use in single-trip of "mono-trip" applications. U.S. Pat. No. 7,228,897 issued to Holt, Jr. et al. ("Holt, Jr.") discloses a "Cement Through Side Pocket Mandrel" that is designed to prevent the cement slurry from settling in the side pocket mandrel during a mono-trip completion operation. To reduce the presence of these potentially fillable cavities within the side pocket mandrel, Holt, Jr. disclosed the use of multiple "filler guide sections" within the pocket tube area of the side pocket mandrel. The guide sections are designed to fill much of the unnecessary interior volume of the side pocket tube and thereby eliminate opportunities for cement to occupy that volume. The filler guide sections also block the cement wiper plug from entering the spaces that the sections occupy, thereby preventing the wiper plug from becoming stuck in such spaces. Holt, Jr. also discloses that filler guide sections generate turbulent circulations within the mandrel voids by the working fluid flow behind the wiper plug to further clean slurry debris from the side pocket mandrel.

FIG. 1 provides a cross-sectional view of a prior art side pocket mandrel 200 that closely follows the design presented in the Holt, Jr. patent. As illustrated in FIG. 1, the side pocket mandrel 200 includes six individual filler guide sections or flow blocks 202, which are distributed on the upstream and downstream sides of the pocket tube 204. The small flow blocks 202 each have a length $L_{F1}$ to $L_{F6}$ and the central portion 206 of the side pocket mandrel has a total length of $L_T$. In this PRIOR ART design, the length of largest individual flow block 202 occupies only about 18% of the total length ($L_T$) of the enlarged central portion 206 of the side pocket mandrel 200.

Although this design proved successful for smaller diameter side pocket mandrels, the use of a plurality of small filler guide sections 202 was found to be ineffective at preventing cement slurry contamination in larger applications. In particular, it was determined that increasing the size of the side pocket mandrel 200 for use in larger production strings, e.g., 4.5" production strings, reduced the efficacy of multiple small flow blocks 202 at preventing cement slurry contamination within the side pocket mandrel 200. There is, therefore, a need for an improved side pocket mandrel that more effectively manages cement slurries in completions with larger diameter production tubing. It is to these and other deficiencies in the prior art that the present disclosure is directed.

SUMMARY OF THE INVENTION

In one aspect, embodiments of the present disclosure are directed to a side pocket mandrel for use in a gas lift system configured to improve the recovery of petroleum fluids from a well. The side pocket mandrel includes an upper assembly joint, a lower assembly joint, and a central portion between the upper assembly joint and the lower assembly joint, where the central portion has a total length ($L_T$). The side pocket mandrel further comprises a central bore extending through the side pocket mandrel. The central bore has a common central longitudinal axis that extends through the upper and lower assembly joints. The side pocket mandrel further includes a tool channel offset from the central bore and a side pocket tube linearly aligned with the tool channel and configured to receive a gas lift valve. To prevent cement slurry from settling within the side pocket mandrel, the side pocket mandrel further includes a pair of primary flow blocks located on opposite sides of the tool channel and laterally offset from the central bore. The primary flow blocks each have a length ($L_{Fa}$) that is at least 35% of the total length ($L_T$) of the central portion of the side pocket mandrel.

In another embodiment, the pair of primary flow blocks occupy substantially all of the space within the central portion above the side pocket tube other than the central bore and tool channel.

In yet another embodiment, each of the primary flow blocks has a length ($L_{Fa}$) that is greater than 50% of the total length ($L_T$) of the central portion.

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells.

Figure 1:
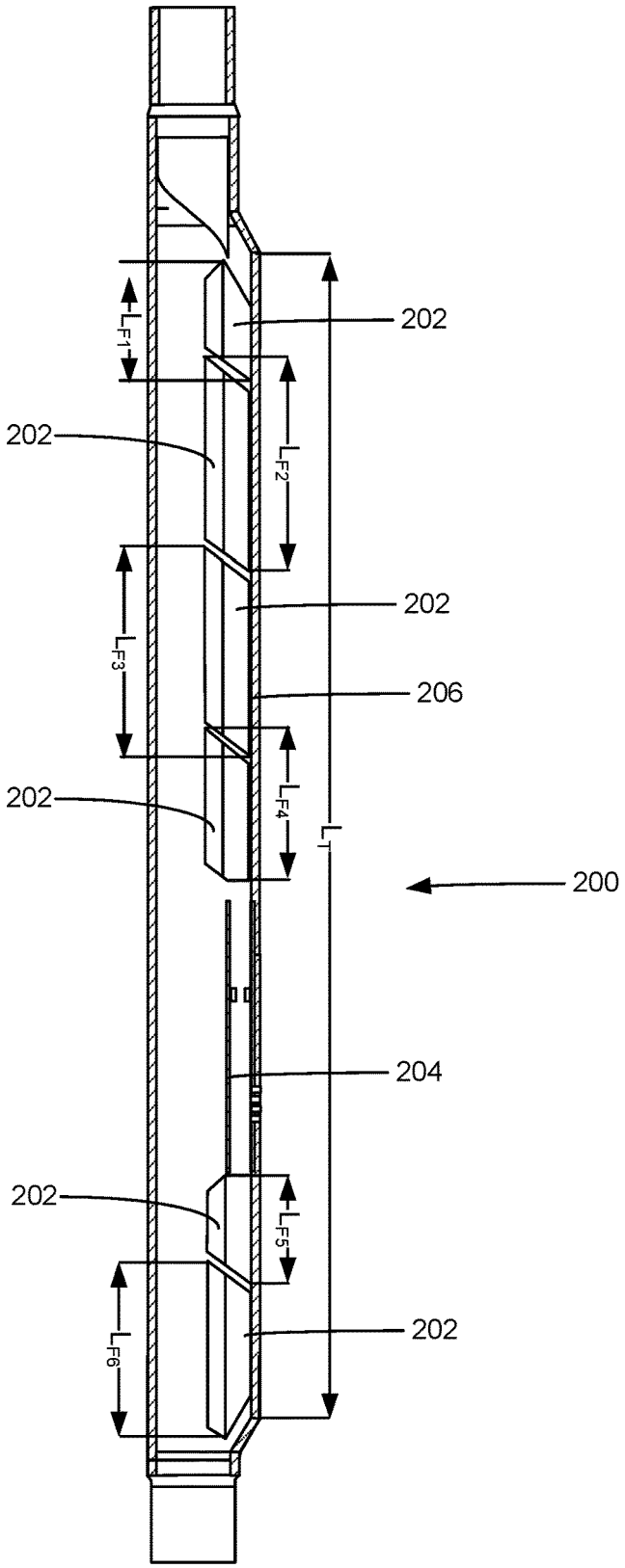
FIG. 1 PRIOR ART
FIG. 1 depicts a PRIOR ART side pocket mandrel designed for use in connection with a mono-trip installation.
Figure 2:
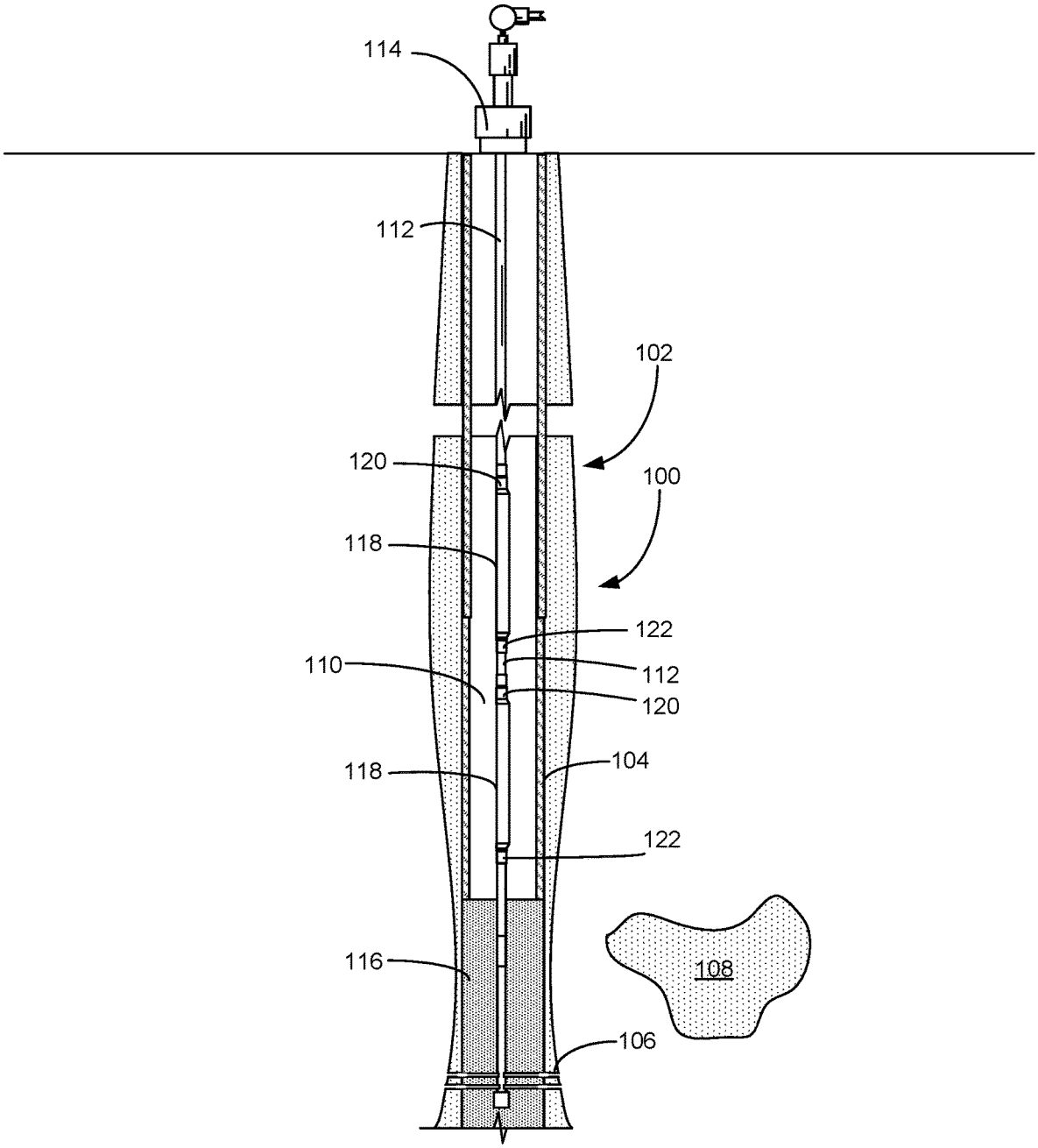
FIG. 2 is a schematic of a gas lift system constructed in accordance with an exemplary embodiment deployed in a wellbore.

Turning to FIG. 1, shown therein is a gas lift system 100 disposed in a well 102. The well 102 includes a casing 104 and a series of perforations 106 that admit wellbore fluids from a producing geologic formation 108 through the casing 104 into the well 102. An annular space 110 is formed between the gas lift system 100 and the casing 104. The gas lift system 100 is connected to production tubing 112 that conveys produced wellbore fluids from the formation 108, through the gas lift system 100, to a wellhead 114 on the surface. In the embodiment depicted in FIG. 1, a cement completion 116 has been used to fill an uncased portion of the well 102 and the perforations 106 have been formed through the cement completion 116. In other applications, the production tubing 112 extends through a packer or other zone isolation device to an area of the well 102 near the perforations 106.

The gas lift system 100 also includes one or more side pocket mandrels 118 connected in line with the production tubing 112 above the cement completion 116. As described above, the side pocket mandrels 118 are configured for use in a "mono-trip" completion in which the cement slurry is pumped down through the production tubing 112 and side pocket mandrels 118 before filling a desired portion of the well 102.

Figure 3:
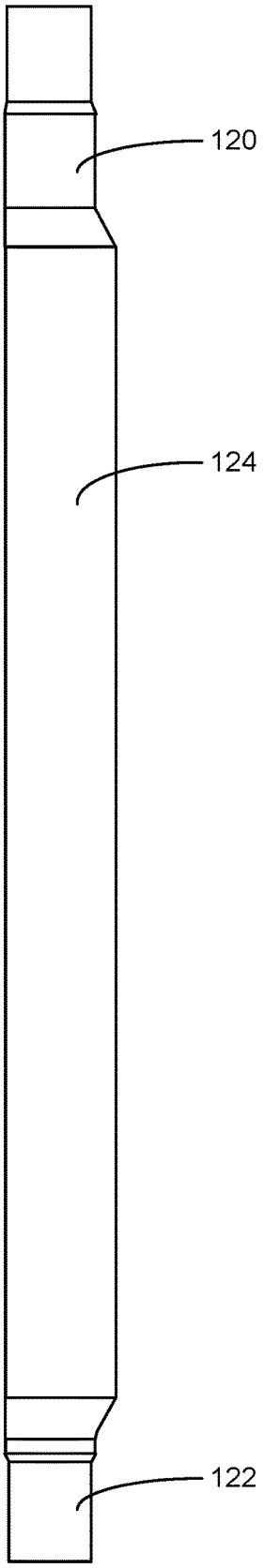
FIG. 3 depicts a side pocket mandrel of the gas lift system of FIG. 2.
Figure 4:
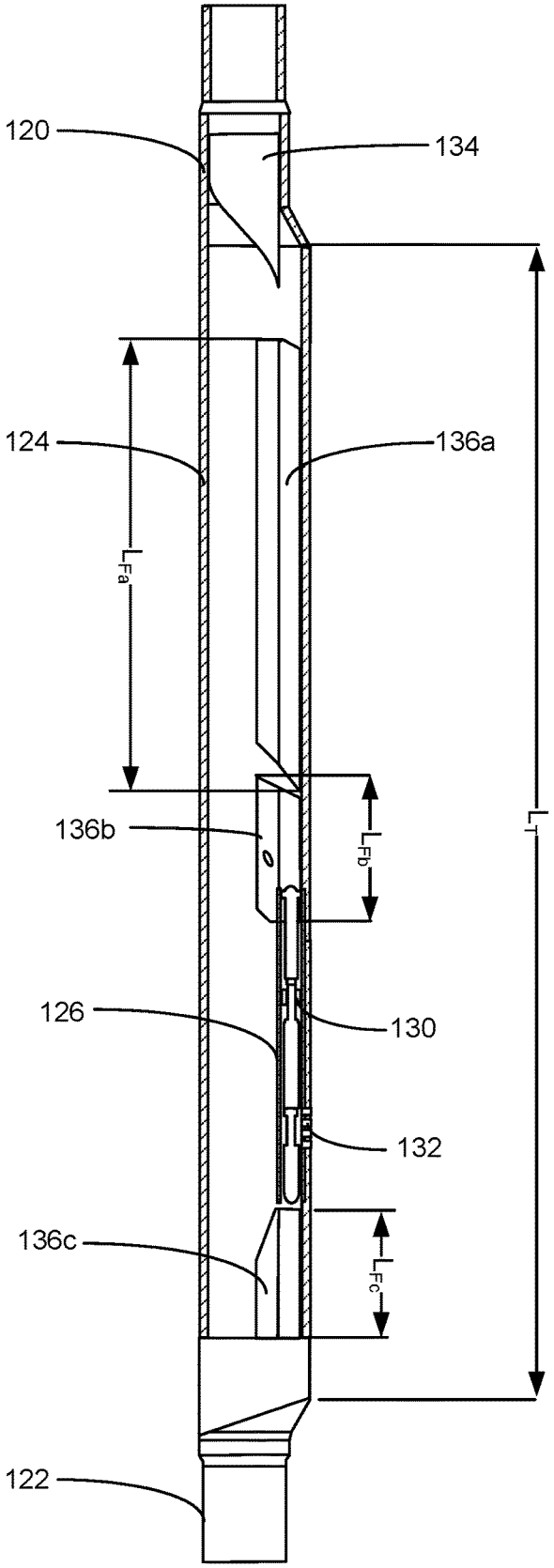
FIG. 4 depicts a side cross-sectional view of the side pocket mandrel of FIG. 3 in a first embodiment.

Turing to FIGS. 3 and 4, shown therein are side and cross-sectional views, respectively, of a first embodiment of the side pocket mandrel 118. The side pocket mandrel 118 generally includes an upper assembly joint 120 and a lower assembly joint 122 on opposite sides of the side pocket mandrel 118. The side pocket mandrel 118 includes an enlarged central portion 124 between the upper and lower assembly joints 120, 122. The central portion 124 has a larger diameter than the upper and lower assembly joints 120, 122 to accommodate the offset location of the gas lift valves.

As best illustrated in FIG. 4, the side pocket mandrel 118 includes a valve pocket or side pocket tube 126 within the central portion 124. The side pocket tube 126 is laterally offset from a central bore 128 that extends collinearly along the central longitudinal axis of the production tubing 112 and upper and lower assembly joints 120, 122. It will be appreciated that the side pocket tube 126 includes a latch mechanism 130 that is designed to releasably retain a gas lift valve or other downhole tool. Ports 132 extend through the outer wall of the central portion 124 into the side pocket tube 126 to provide a path for fluids to move between the annular space 110 and the interior of the side pocket tube 126. A guide sleeve 134 can be located near the upper assembly joint 120 to facilitate the engagement and use of a kickover tool, which is designed to install and remove a gas lift valve or other tool in the side pocket tube 126. During a cementing operation, a temporary plug can be used to prevent cement from entering the side pocket tube 126, where the cement might otherwise foul the latch mechanism 128 or escape through the ports 132.

Figure 5:
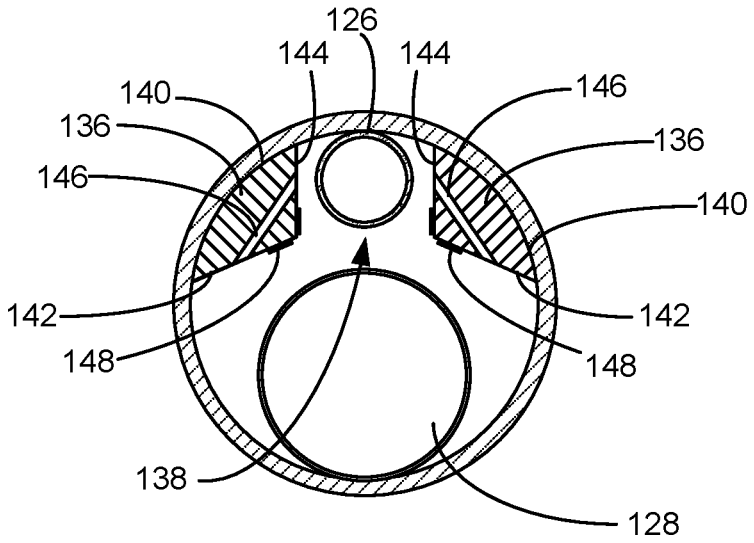
FIG. 5 depicts an end cross-sectional view through the side pocket mandrel of FIG. 3.

To prevent the cement from collecting within voids in the side pocket mandrel 118, the side pocket mandrel 118 includes a plurality of flow blocks 136. Exemplary embodiments of the flow blocks 136 are depicted in the cross-sectional views of FIG. 4 and FIG. 5 and the perspective views in FIG. 6. In most embodiments, two series of linearly aligned flow blocks 136 are installed in pairs within the enlarged central portion 124 of the side pocket mandrel 118. As illustrated in the cross-sectional view in FIG. 5, the flow blocks 136 are generally located in the two quadrants on opposite sides of a tool channel 138, which is linearly aligned with the side pocket tube 126. The pair of first or "primary" flow blocks 136 are located above the side pocket tube 126 on opposite sides of the tool channel 138 and laterally offset from the central bore 128. In this way, the two sets of flow blocks 136 together define two sides of the tool channel 138, which permits the installation and removal of gas lift valves and other tools within the side pocket tube 126 of the side pocket mandrel 118.

The flow blocks 136 are generally configured as three-sided, elongate prisms with an arcuate outer face 140, a wiper plug engagement face 142, and a tool engagement face 144. The arcuate outer face 140 has a curvature that matches and contacts the curvature of the interior of the central portion 124 of the side pocket mandrel 118. In exemplary embodiments, each flow block 136 is secured to the interior of the side pocket mandrel 118 by welding the flow block 136 to the side pocket mandrel 118 through welding apertures (not separately shown) that extend through the side pocket mandrel 118 to permit exterior access to the flow blocks 136 for the welding operation.

The wiper plug engagement faces 142 are generally directed toward the central bore 128 and provide surfaces which are contacted by the wiper plug as it traverses the side pocket mandrel 118. The wiper plug engagement faces 142 prevent the wiper plug from becoming unintentionally trapped or blocked by the side pocket tube 126. The passage of the wiper plug through the side pocket mandrel 118 is described in U.S. Pat. Nos. 7,069,992, 7,228,897 and 7,373,980, the disclosures of which are incorporated by reference as if fully set forth herein. The tool engagement faces 144 generally face one on opposite sides of the tool channel 138. Importantly the tool engagement faces 144 are oriented and spaced apart in a way that does not obstruct the installation and removal of gas lift valves or other tools.

Figure 6:
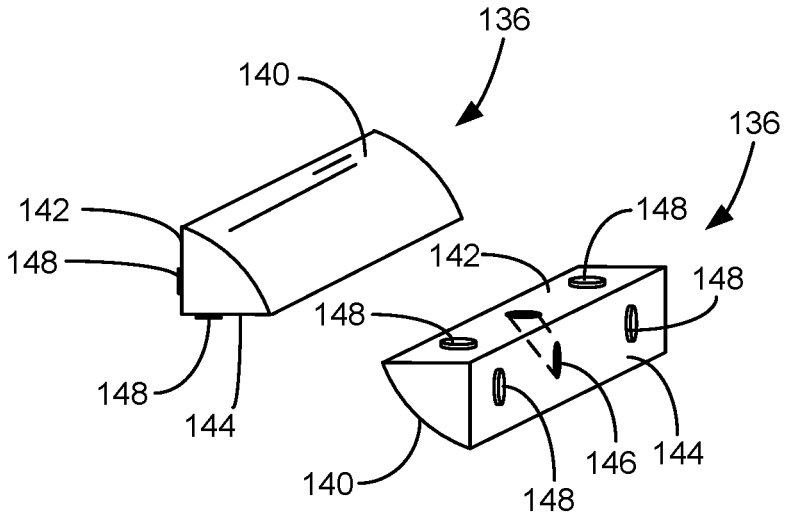
FIG. 6 provides a perspective view of two flow block members for the side pocket mandrel of FIG. 2.

As best illustrated in FIG. 6, the flow blocks 136 can include jet passages 146 and vortex generators 148 to increase the turbulence of fluid passing through the side pocket mandrel 118. The jet passages 146 increase circulation between the tool channel 138 and the central bore 128. The vortex generators 148 are generally configured as bumps, buttons, vanes or other projects that extend off the wiper plug and tool engagements faces 142, 144 to further induce turbulent flow as fluid passes through the side pocket mandrel 118. In each case, the increased turbulence of washout fluid passing through the side pocket mandrel 118 following a cementing operation removes cement slurry particles that remain in small voids within the side pocket mandrel 118.

Turning back to FIG. 4, the side pocket mandrel 118 includes a pair of large flow blocks 136*a* rather than a plurality of smaller flow blocks as disclosed in the prior art. The use of a pair of large flow blocks 136*a* has been determined to better prevent the accumulation of cement slurry within the side pocket mandrel 118, particularly when the side pocket mandrel 118 is sized for deployment with larger diameter production tubing 112. In some embodiments, the side pocket mandrel 118 includes a first pair of flow blocks 136*a* that each have a length ($L_{Fa}$) of more than 35% of the total length ($L_T$) of the central portion 124 of the side pocket mandrel 118. In some embodiments, each of the first pair of flow blocks 136*a* each has a length ($L_{Fa}$) of more than about 38% of the total length ($L_T$). In the particular embodiment depicted in FIG. 3, the longest flow blocks 136*a* each have a length ($L_{Fa}$) of about 39% of the total length ($L_T$) of the central portion 124. In the embodiment depicted in FIG. 4, the side pocket mandrel 118 further includes a second set of flow blocks 134*b* between the primary set of flow blocks 134*a* and the side pocket tube 126, and a third set of flow blocks 134*c* on the opposite (lower) side of the side pocket tube 126. The second and third sets of flow blocks 134*b*, 134*c* have lengths that more closely approximate the shorter lengths of conventional flow blocks presented in the prior art discussed above.

Figure 7:
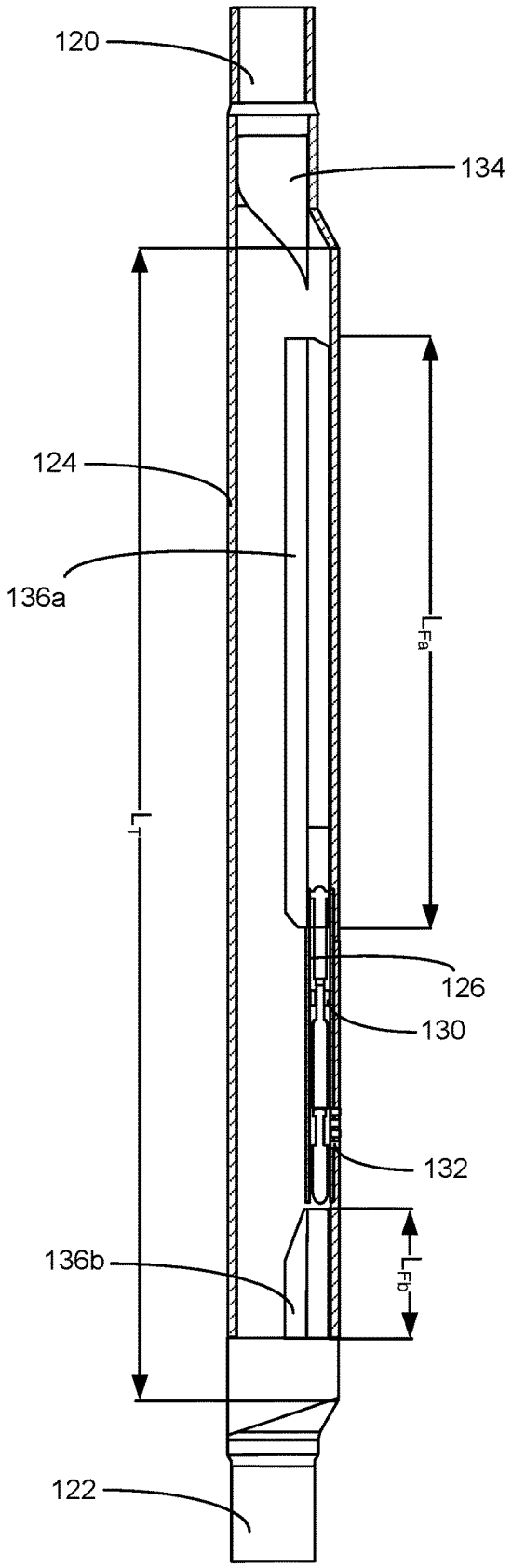
FIG. 7 depicts a side cross-sectional view of the side pocket mandrel of FIG. 3 in a second embodiment.

Turning to FIG. 7, shown therein is another embodiment in which the side pocket mandrel 118 is fitted with first and second pairs of flow blocks 136*a*, 136*b*. In this embodiment, each of the first pair of flow blocks 136*a* has a total length ($L_{Fa}$) of more than about half 50% of the total length of the central portion 124 of the side pocket mandrel 118. In other embodiments, the first pair of flow blocks 136 have a total length ($L_{Fa}$) of about 53% of the total length of the central portion 124. In other embodiments, the first pair of flow blocks 136*a* have a total length ($L_{Fa}$) of about 65% of the total length of the central portion 124.

Thus, the side pocket mandrels 118 constructed in accordance with exemplary embodiments include at least one pair of flow blocks 136 that have lengths that are designed to minimize the presence of voids in the side pocket mandrel 118. The longest flow blocks 136 disclosed herein have proportional to the total length of the central portion of the side pocket mandrel that are at least twice as long as the longest flow blocks disclosed in the prior art. In some embodiments, the longest flow blocks 136 have lengths ($L_{FA}$) that are greater than half the total length ($L_T$) of the central portion 124 of the side pocket mandrel 118.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A side pocket mandrel for use in a gas lift system configured to improve the recovery of petroleum fluids from a well, the side pocket mandrel comprising:

an upper assembly joint;

a lower assembly joint;

a central portion between the upper assembly joint and the lower assembly joint, the central portion having a total length ($L_T$);

a central bore extending through the side pocket mandrel, wherein the central bore has a common central longitudinal axis that extends through the upper and lower assembly joints;

a tool channel offset from the central bore;

a side pocket tube linearly aligned with the tool channel and configured to receive a gas lift valve; and a pair of primary flow blocks, wherein the pair of primary flow blocks are located on opposite sides of the tool channel and laterally offset from the central bore, and wherein the primary flow blocks each have a continuous length ($L_{Fa}$) that is at least 35% of the total length ($L_T$) of the central portion of the side pocket mandrel.

2. The side pocket mandrel of claim 1, wherein the length ($L_{Fa}$) is at least 38% of the total length ($L_T$) of the central portion of the side pocket mandrel.

3. The side pocket mandrel of claim 1, wherein the length ($L_{Fa}$) is at least 50% of the total length ($L_T$) of the central portion of the side pocket mandrel.

4. The side pocket mandrel of claim 1, wherein the length ($L_{Fa}$) is 53% of the total length ($L_T$) of the central portion of the side pocket mandrel.

5. The side pocket mandrel of claim 1, wherein the length ($L_{Fa}$) is 65% of the total length ($L_T$) of the central portion of the side pocket mandrel.

6. The side pocket mandrel of claim 1, wherein the primary flow blocks each comprise:

an arcuate outer face;

a wiper plug engagement face; and a tool engagement face.

7. The side pocket mandrel of claim 6, wherein the primary flow blocks each comprise one or more jet passages that extend between the wiper plug engagement face and the tool engagement face.

8. The side pocket mandrel of claim 6, wherein the primary flow blocks each comprise one or more vortex generators extending away from the wiper plug engagement face.

9. The side pocket mandrel of claim 6, wherein the primary flow blocks each comprise one or more vortex generators extending away from the tool engagement face.

10. The side pocket mandrel of claim 1, wherein the side pocket mandrel further comprises a pair of secondary flow blocks, wherein the pair of secondary flow blocks are located above or below the corresponding pair of primary flow blocks.

11. A side pocket mandrel for use in a gas lift system configured to improve the recovery of petroleum fluids from a well, the side pocket mandrel comprising:

an upper assembly joint;

a lower assembly joint;

a central portion between the upper assembly joint and the lower assembly joint, the central portion having a total length ($L_T$);

a central bore extending through the side pocket mandrel, wherein the central bore has a common central longitudinal axis that extends through the upper and lower assembly joints;

a tool channel offset from the central bore;

a side pocket tube linearly aligned with the tool channel and configured to receive a gas lift valve; and a pair of primary flow blocks, wherein the pair of primary flow blocks are located on opposite sides of the tool channel and laterally offset from the central bore, and wherein the primary flow blocks each have a continuous length ($L_{Fa}$) that is at least 50% of the total length ($L_T$) of the central portion of the side pocket mandrel.

12. The side pocket mandrel of claim 11, wherein the length ($L_{Fa}$) is 53% of the total length ($L_T$) of the central portion of the side pocket mandrel.

13. The side pocket mandrel of claim 11, wherein the length ($L_{Fa}$) is 65% of the total length ($L_T$) of the central portion of the side pocket mandrel.

14. The side pocket mandrel of claim 11, wherein the primary flow blocks each comprise:

an arcuate outer face;

a wiper plug engagement face; and a tool engagement face.

15. The side pocket mandrel of claim 14, wherein the primary flow blocks each comprise one or more jet passages that extend between the wiper plug engagement face and the tool engagement face.

16. The side pocket mandrel of claim 14, wherein the primary flow blocks each comprise one or more vortex generators extending away from the wiper plug engagement face and the tool engagement face.

17. A side pocket mandrel for use in a gas lift system configured to improve the recovery of petroleum fluids from a well, the side pocket mandrel comprising:

an upper assembly joint;

a lower assembly joint;

a central portion between the upper assembly joint and the lower assembly joint, the central portion having a total length ($L_T$);

a central bore extending through the side pocket mandrel, wherein the central bore has a common central longitudinal axis that extends through the upper and lower assembly joints;

a tool channel offset from the central bore;

a side pocket tube linearly aligned with the tool channel and configured to receive a gas lift valve; and a pair of primary flow blocks, wherein the pair of primary flow blocks are located above the side pocket tube on opposite sides of the tool channel and laterally offset from the central bore, and wherein each of the primary flow blocks has a continuous length ($L_{Fa}$) that is greater than 50% of the total length ($L_T$) of the central portion.

18. The side pocket mandrel of claim 17, the primary flow blocks each have a length ($L_{Fa}$) that is about 53% of the total length ($L_T$) of the central portion of the side pocket mandrel.

* * * * *